US008800221B1

(12) United States Patent
Header

(10) Patent No.: US 8,800,221 B1
(45) Date of Patent: Aug. 12, 2014

(54) VERTICAL AND SLOPED GLAZING FRAMING MEMBERS STRUCTURED FOR ELECTRICAL WIRING

(71) Applicant: Gregory Header, Richland, PA (US)

(72) Inventor: Gregory Header, Richland, PA (US)

( * ) Notice: Subject to any disclaimer, the term of this patent is extended or adjusted under 35 U.S.C. 154(b) by 0 days.

(21) Appl. No.: 13/902,553

(22) Filed: May 24, 2013

(51) Int. Cl.
*E06B 3/00* (2006.01)
*E04B 2/88* (2006.01)

(52) U.S. Cl.
CPC ..... *E04B 2/88* (2013.01)
USPC ..... 52/204.5; 52/220.1; 52/220.2; 52/220.3; 52/220.7; 52/220.8

(58) Field of Classification Search
USPC ..... 52/204.5, 220.1–220.4, 220.7, 220.8
See application file for complete search history.

(56) References Cited

U.S. PATENT DOCUMENTS

| | | | | |
|---|---|---|---|---|
| 3,064,110 | A | 11/1962 | Vogler | |
| 3,195,698 | A | 7/1965 | Codrea | |
| 4,982,536 | A | 1/1991 | Muhlethaler | |
| 5,253,459 | A | 10/1993 | Parinas et al. | |
| 5,309,689 | A | 5/1994 | Croissant | |
| 5,792,992 | A | 8/1998 | Handler | |
| 5,839,236 | A | 11/1998 | Frey | |
| 6,158,182 | A | 12/2000 | Biebuyck | |
| 6,465,724 | B1 * | 10/2002 | Garvison et al. | 136/244 |
| 6,993,873 | B2 | 2/2006 | Biebuyck et al. | |
| 7,036,280 | B2 | 5/2006 | Hogan | |
| 7,201,205 | B2 * | 4/2007 | Lyness et al. | 160/107 |
| 7,600,349 | B2 * | 10/2009 | Liebendorfer | 52/173.3 |
| 7,845,126 | B2 | 12/2010 | Brescia | |
| 7,845,127 | B2 | 12/2010 | Brescia | |
| 7,845,128 | B2 | 12/2010 | Brescia | |
| 7,847,181 | B2 | 12/2010 | Brescia | |
| 7,941,982 | B2 | 5/2011 | Merica | |

(Continued)

FOREIGN PATENT DOCUMENTS

| | | | |
|---|---|---|---|
| CN | 200999405 | Y | 1/2008 |
| CN | 201605693 | Y | 10/2010 |

(Continued)

OTHER PUBLICATIONS

Ben Johnson, New Transparent Polymer Solar Cells Could Cover Skyscrapers and Tablets, Slate.com, Jul. 23, 2012, accessed on the Internet: http://www.slate.com/blogs/future_tense/2012/07/23/new_polymer_solar_cells_you_can_see_through_could_cover_skyscrapers_and_tablets.html.

(Continued)

*Primary Examiner* — Mark Wendell
(74) *Attorney, Agent, or Firm* — Stone Creek Services LLC; Alan M Flum

(57) ABSTRACT

Disclosed is a vertical or a sloped glazing system that facilitates wire routing from electrically producing or consumptive glazing materials such as solar PV panels or electrochromic glass. The glazing system includes vertical and horizontal framing members, each with enclosed cavities and outward facing gutters. The vertical framing member gutter is deeper than the horizontal framing member gutter, creating an offset between the enclosed cavities such that a portion of the vertical wall of the vertical framing member gutter aligns with the enclosed cavity of the horizontal framing member. Electrical wire can be routed from the vertical framing member gutter into the horizontal framing member enclosed cavity through a wire-receiving aperture in the vertical frame member gutter wall portion that is aligned with the horizontal framing member enclosed cavity. This arrangement allows wiring between the outside and inside building environment while minimizing the possibility of water infiltration.

16 Claims, 11 Drawing Sheets

(56) References Cited

U.S. PATENT DOCUMENTS

| | | | | |
|---|---|---|---|---|
| 8,171,679 | B2 * | 5/2012 | Brescia et al. | 52/173.3 |
| 8,333,041 | B2 | 12/2012 | Brescia | |
| 8,365,482 | B2 | 2/2013 | Merica | |
| 8,381,465 | B2 | 2/2013 | Brescia et al. | |
| 2005/0210780 | A1 * | 9/2005 | Lyness et al. | 52/204.5 |
| 2010/0229479 | A1 | 9/2010 | Burkhard et al. | |

FOREIGN PATENT DOCUMENTS

| | | | |
|---|---|---|---|
| CN | 202157436 | U | 3/2012 |
| CN | 102704633 | A | 10/2012 |
| CN | 102797361 | A | 11/2012 |
| CN | 202627271 | U | 12/2012 |
| CN | 202706282 | U | 1/2013 |
| CN | 202718259 | U | 2/2013 |
| CN | 202817000 | U | 3/2013 |
| KR | 101078796 | B | 10/2011 |
| WO | 2012089883 | A2 | 7/2012 |

OTHER PUBLICATIONS

Ucilia Wang, Konarka Runs Solar Curtain Wall Pilot, Greentech Solar, Nov. 10, 2009, accessed on the Internet: http://www.greentechmedia.com/articles/read/konarka-runs-solar-curtain-wall-pilot.

Chun-Chao Chen et al, Visibly Transparent Polymer Solar Cells Produced by Solution Processing, ACS Nano, 2012, 6 (8), Jul. 4, 2012, pp. 7185-7190, American Chemical Society, Washington, D.C., US.

SageGlass dynamic glass for commerical, industrial and residential buildings, Apr. 4, 2012, Sage Electrochomics, Inc., Fairbualt, MN, US.

Helen Sanders, Lou Podbelski, A guide to installing electronically tintable glass, Glass Magazine, Aug. 2011, pp. 56-59, National Glass Association, McLean, VA, US.

* cited by examiner

VERTICAL AND SLOPED GLAZING FRAMING MEMBERS STRUCTURED FOR ELECTRICAL WIRING

BACKGROUND

The present disclosure relates to vertical and sloped glazing systems. Specifically, for vertical and sloped glazing framing members structured for electrical wiring.

The primary purpose of a vertical or a sloped glazing system is to protect the interior of the building from the outside environment. However, both vertical and sloped glazing systems can also fulfill an aesthetic purpose or provide other utilitarian functions. For example, a glass or transparent polymer vertical glazing structure, such as a curtain wall, or a sloped glazing system, such as a skylight roof, can provide a view of the surrounding area to the building occupants or provide natural light into the building interior.

Recently, there are both vertical and sloped glazing systems that include glazing that converts sunlight to electricity, for example, crystalline and poly-crystalline solar photovoltaic (PV) panels, and semi-transparent organic PV panels and films. It has been suggested, that a recently developed class of visibly transparent polymer solar cells (PSC) that transmit visible light, but convert near-infrared photons into electricity, could be used to cover building facades in the near future. In addition, some vertical and sloped glazing utilize electrochromic glass for electronically tinting the glazing. All of the above electrically producing or electrically consumptive glazing materials require electrical wiring.

One of the challenges in providing electrical wiring to electrically producing or consumptive glazing materials in both vertical and sloped glazing systems is to do so while not interfering with the glazing system's ability to provide an airtight and watertight structural barrier from the outside environment. Another challenge is to provide service access to the wiring for possible future repair and maintenance. An additional challenge is to accomplish both of these goals while not disturbing the aesthetic appearance of the glazing system.

Current attempts to solve the problem of routing electrical wiring from the glazing material into framing structure of the glazing system include drilling holes into the framing element directly behind the glazing. This can cause possible problems with water infiltration over time and often does not provide easy post-installation access for maintenance or repair. Other attempts to solve the problem include routing the wires through surface mounted objects. This can create an undesirable aesthetic appearance.

SUMMARY

The present disclosure describes vertical or sloped glazing systems that facilitates wire routing to electrically producing or consumptive glazing materials such as solar PV panels, visibly transparent PSC, or electrochromic glass, or any other infill material that employs electrical wiring or conduits, while attempting to overcome the above described challenges.

In one aspect, the glazing system includes vertical and horizontal framing members, glazing panels, and pressure bar assemblies. The vertical and horizontal framing members include framing member gutters, glazing supports projecting upward from the bottom of the gutters, and enclosed cavities below the gutters. The bottom of the vertical framing member gutter is aligned with the horizontal framing member so it intersects a portion of the horizontal framing member's enclosed cavity. Electrical wire can be routed between the vertical framing member gutter and the enclosed cavity of horizontal framing member through an aperture between the two elements. The tops of both the vertical and horizontal framing member glazing supports are aligned in the same plane to engage the pressure bars and to seat and secure a glazing panel.

Routing the electrical wire between the vertical framing member gutter and the enclosed cavity of the horizontal framing member allows the electrical wire to transfer from the exterior to the interior portion of the glazing system while minimizing the possibility of water infiltration into the interior structure of the glazing system. For example, as positive pressure is applied by wind, rain, and other environmental elements to the glazing panel, any water infiltration will tend to be pressed against the horizontal framing member gutter and flow down the sides of the vertical framing member gutter until it hits the bottom sill and is drained out through weep holes. In order to help reduce the possibility of air and moisture penetration and improve acoustical performance, and to prevent electrical wires chaffing against metal edges, any voids between the electrical wire and the aperture can be sealed with a flexible water proof or water resistant material. For example, the void can be sealed with silicon caulking or an elastomeric washer, grommet, or gasket.

The back surface of the horizontal and vertical framing members can be made removable so that the electrical wiring can be accessed and serviced from inside the building. An aperture can be drilled between the vertical and horizontal framing member enclosed cavities in order to route the electrical wire between them. This in combination with the removable back surfaces of the horizontal and the vertical framing member, facilitates routing wire between the horizontal framing member enclosed cavity within the interior building structure and allows the electrical wires to be routed invisibly throughout the entire glazing system.

The novel structure described above can be applied to a wide range of vertical and sloped glazing systems. For example, the glazing system can be applied to a stick-built vertical curtain wall where the vertical frame members are vertical mullions and the horizontal framing members are horizontal mullions. In addition, the novel structure can be applied to skylights and other sloped glazing systems, for example, hipped-end skylight, polygon shaped skylights, pyramid skylights, and greenhouses where the vertical framing members are sloped rafters and the horizontal framing members are purlins. The novel structure can be applied to modular vertical and sloped glazing systems, for example, modular skylight structures. The novel structure can be applied to pre-glazed, pre-assembled vertical or sloped glazing systems, for example, unitized curtain walls. In addition, the novel structure can be applied to pre-assembled glazing framing structures that are not pre-glazed.

This Summary has introduced a selection of concepts in simplified form that are described in more detail in the Description. The Summary is not intended to identify essential features or limit the scope of the claimed subject matter.

DRAWINGS

DESCRIPTION

For the purpose of this disclosure, the terms "left" or "right" are used as relative terms in relation to the figures. These terms are not used to denote absolute direction, or orientation and do not imply a preference or limitation for a particular orientation. Throughout this disclosure, the term "horizontal framing member" is used to denote a horizontal mullion in a vertical glazing system or a purlin in a sloped glazing system. The term "vertical framing member" is used to denote a vertical mullion in a vertical glazing system or a rafter in a sloped glazing system.

Figure 1:
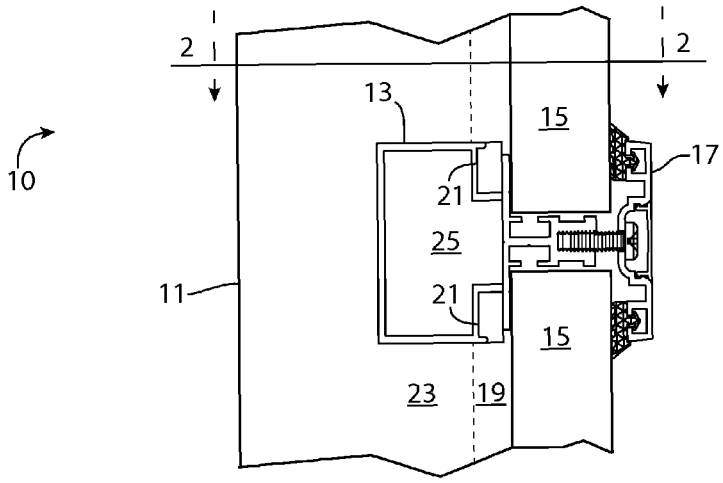
FIG. 1 PRIOR ART
FIG. 1 shows a side cutaway view portion illustrating the relationship between the vertical and the horizontal frame members in the prior art.
Figure 2:
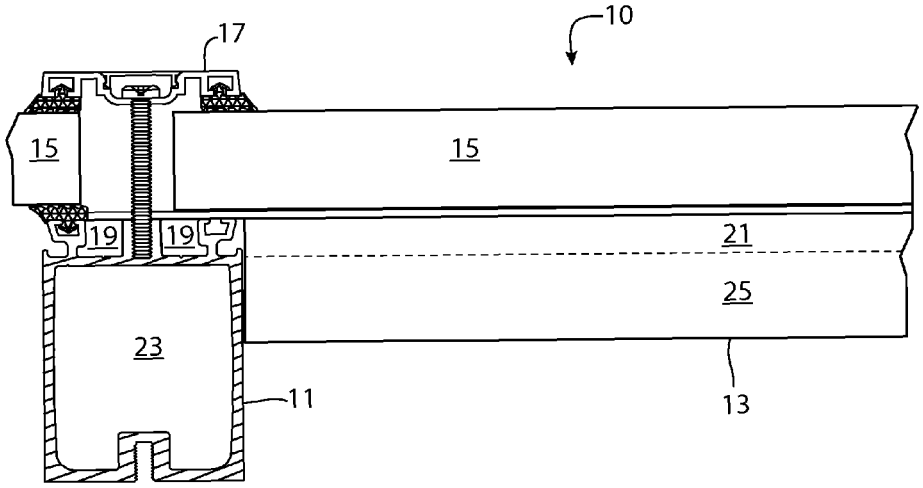
FIG. 2 PRIOR ART
FIG. 2 shows a sectional view of FIG. 1.

Throughout this Description, reference is made to the figures, where like numerals refer to like elements throughout the several views. FIGS. 1-2 show portions of a glazing system 10 known in the art. FIG. 1 shows a side cutaway view of a portion of the glazing system 10 illustrating the relationship between a vertical framing member 11 and a horizontal framing member 13. FIG. 2 shows a sectional view of FIG. 1. In FIGS. 1-2, the vertical framing member 11 can be a vertical mullion, for example, in a curtain wall or vertical glazing system, or a rafter, in a skylight or a sloped glazing system. The horizontal framing member 13 can be a horizontal mullion, for example, in a vertical glazing system. Alternatively, the horizontal framing member 13 can be, for example, a purlin, a crossbar member, or a skylight crossbar, in a sloped glazing system. A glazing panel 15 is secured to the vertical framing member 11 and the horizontal framing member 13 by a pressure bar assembly 17. The glazing panel 15 can be a sheet of glass, or alternatively electrically producing or consumptive glazing material such as solar PV panels, visibly transparent PSC, or electrochromic glass, or other infill materials that employ wiring or conduits. The vertical framing member 11 and the horizontal framing member 13 are aligned squarely so that the vertical framing member gutter 19 aligns with the horizontal framing member gutter 21. In FIG. 1, the vertical framing member gutter 19 is hidden and shown as a region adjacent to the glazing panel 15. The horizontal framing member gutter 21 is hidden in FIG. 2 and shown as a region adjacent to the glazing panel 15 above the broken lines.

One of the challenges presented by the arrangement of FIGS. 1-2 is that there is no direct manner for routing the wire into interior of the building without risking water leakage. Because of limited access, routing a wire into the vertical framing member enclosed cavity 23 or the horizontal framing member enclosed cavity 25, both which potentially access the interior of the building, would require drilling a hole into either cavity on the surface parallel to the glazing panel 15. Pressure on the exterior structure creates positive pressure on these surfaces creating the potential for water leakage.

Figure 3:
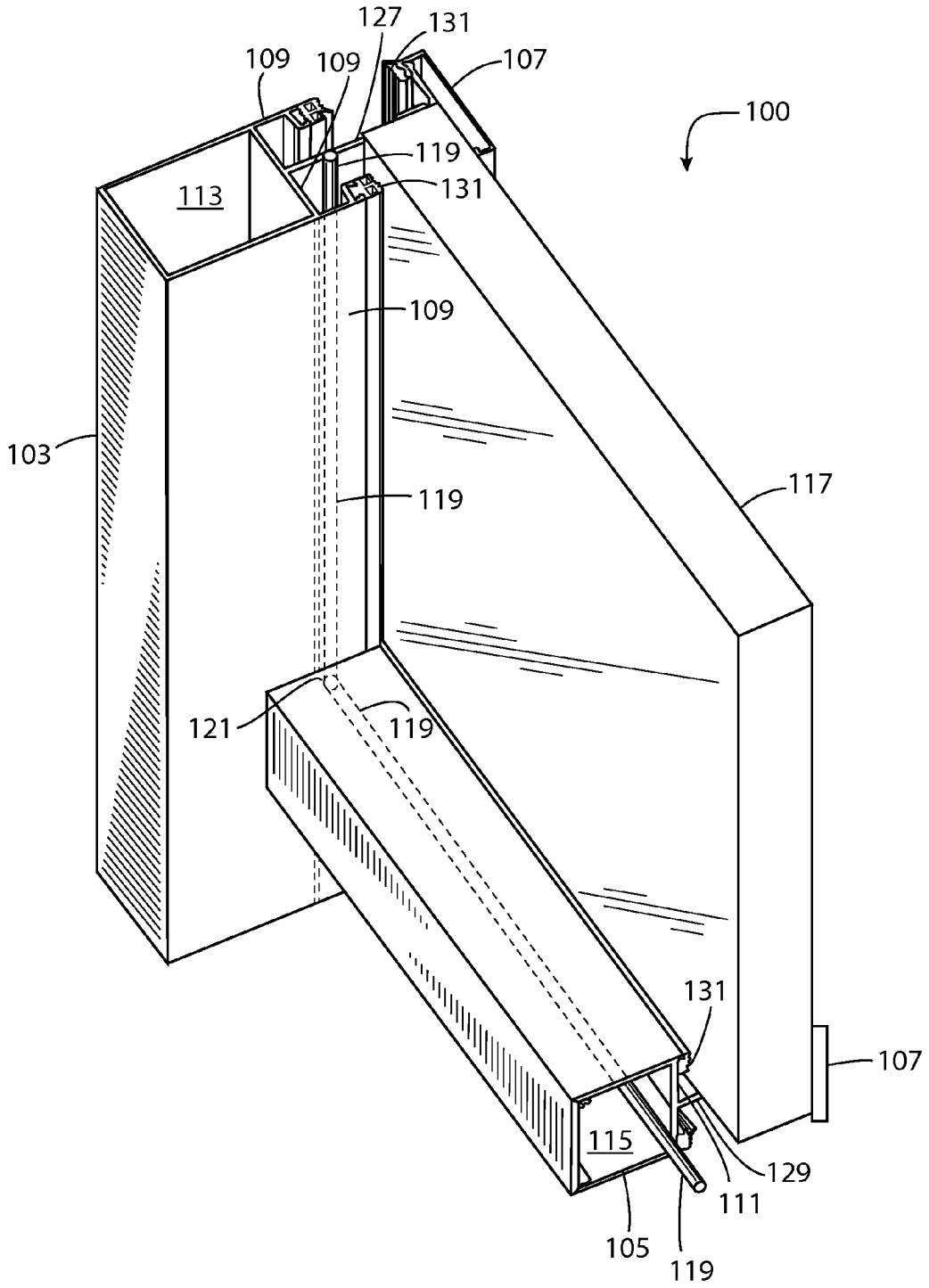
FIG. 3 shows a perspective view of a novel structure that can be applied to both vertical and sloped glazing systems.
Figure 4:
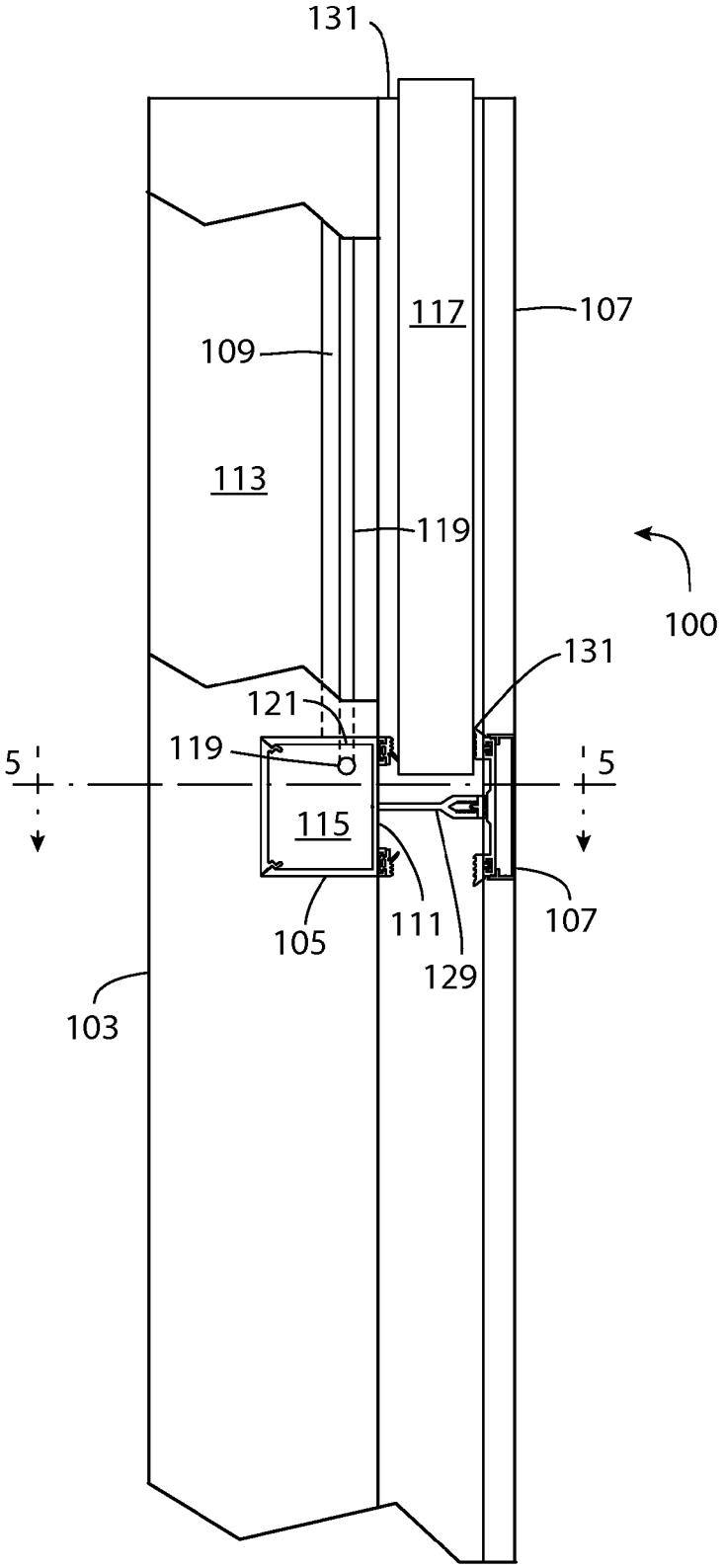
FIG. 4 shows a side view of FIG. 3.
Figure 5:
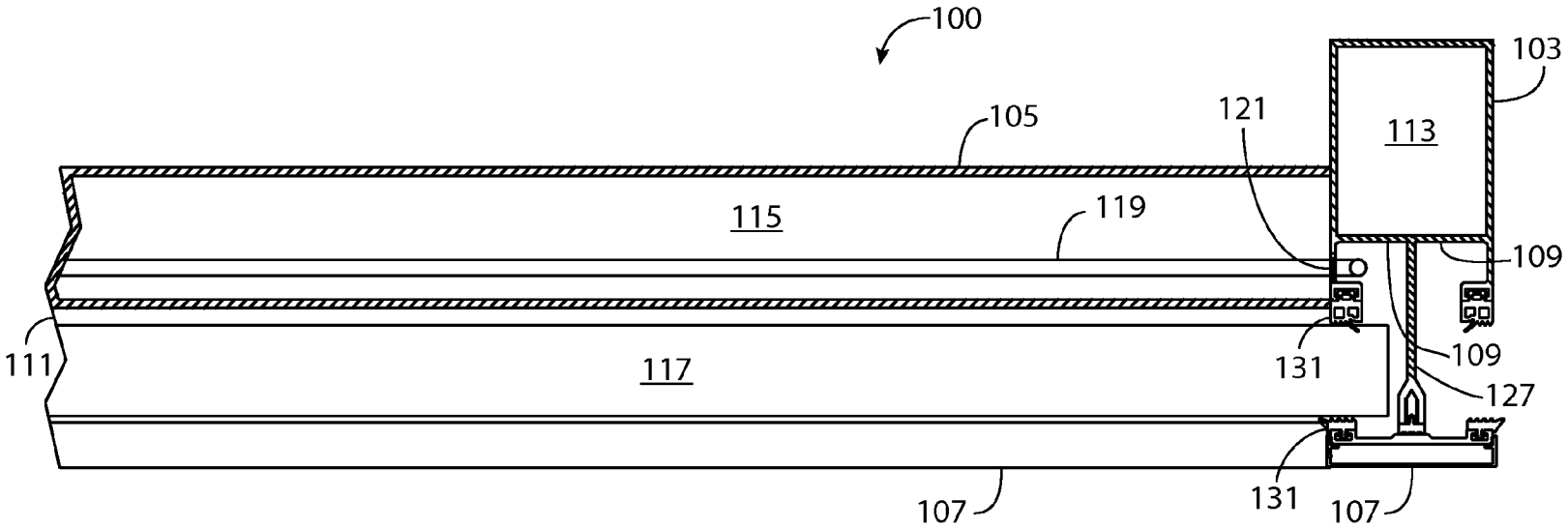
FIG. 5 shows a sectional view of FIG. 4.
Figure 6:
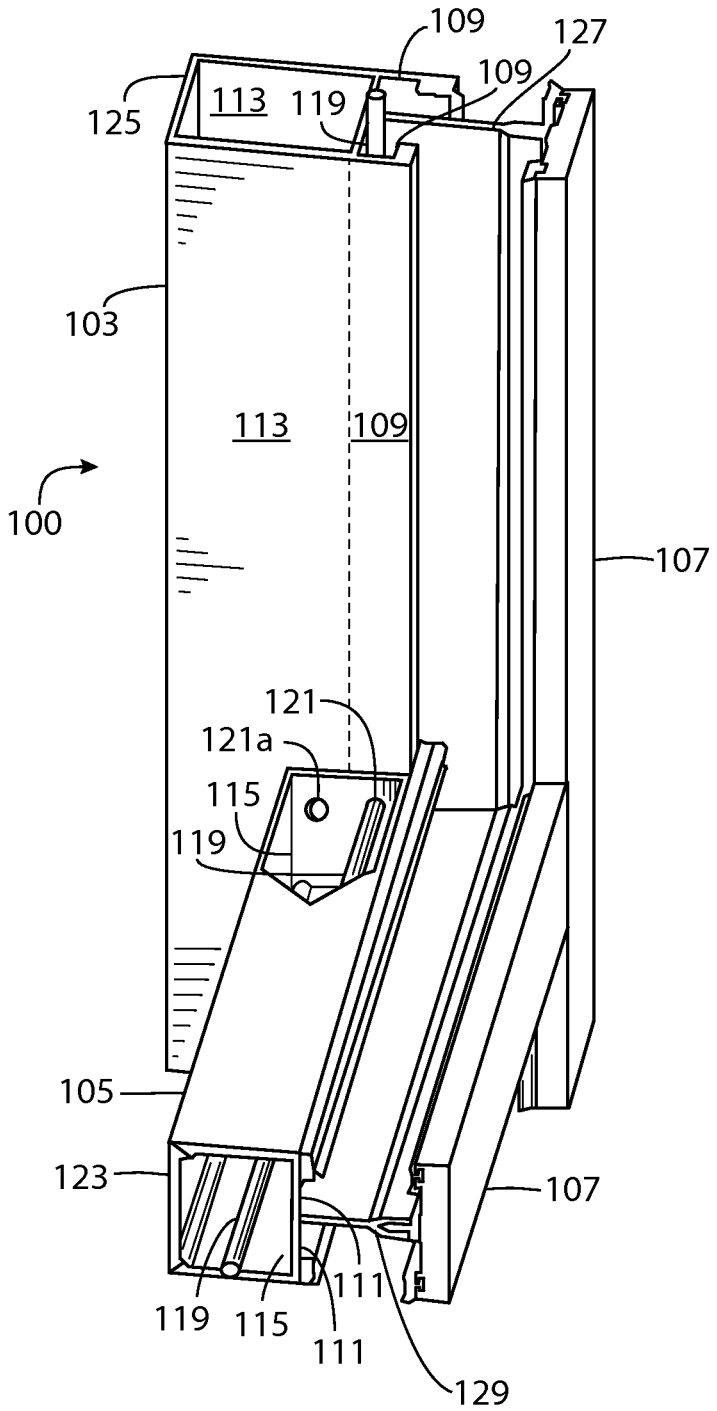
FIG. 6 shows a side perspective view of FIG. 3 showing a partial cutaway on the horizontal framing member for clarity.
Figure 7:
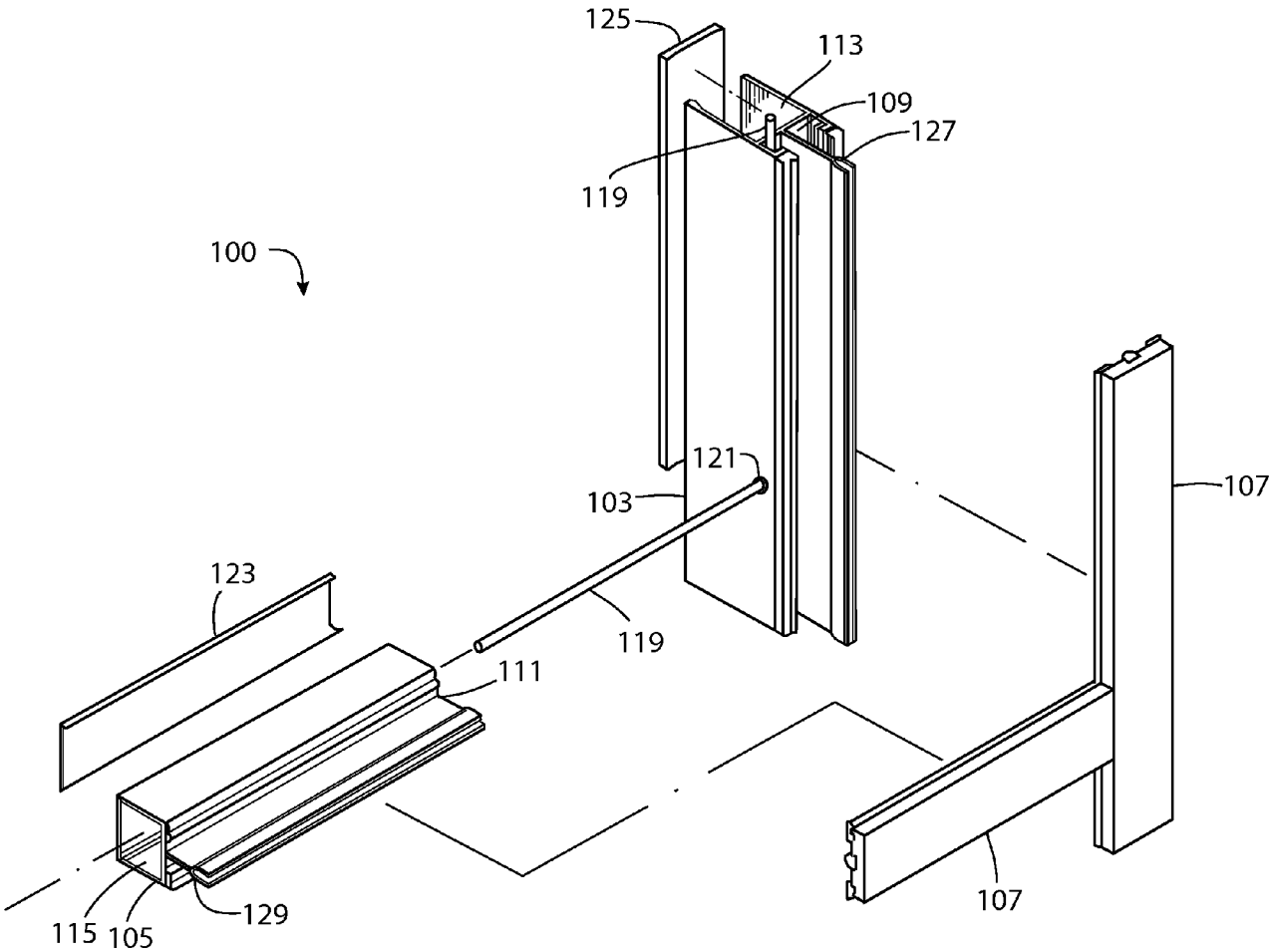
FIG. 7 shows a partial exploded view of FIG. 3.
Figure 8:
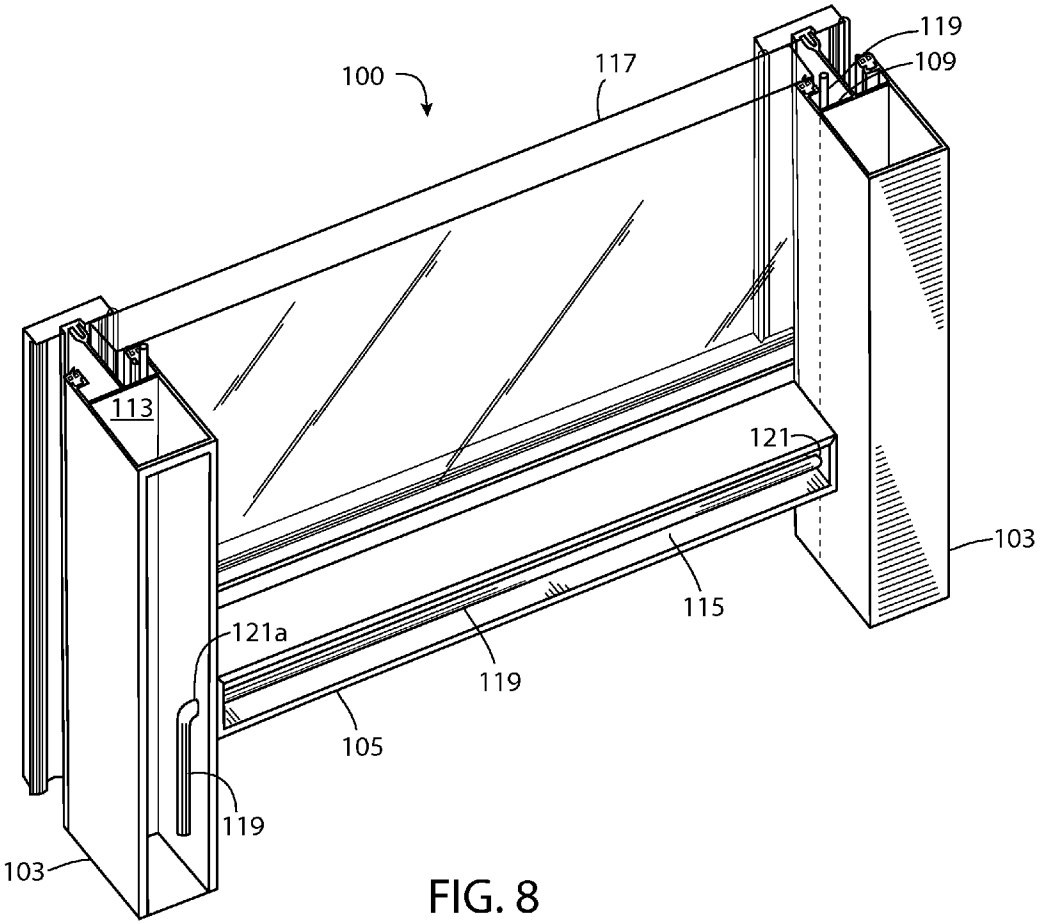
FIG. 8 shows a rear perspective view of the glazing section of FIG. 3 showing two vertical framing members.

FIGS. 3-8 show portions of a novel structure, which can be applied to both vertical and sloped glazing systems and any infill that employs electrical wiring or conduit connectors. This glazing system 100 overcomes the challenges presented by FIGS. 1-2. FIG. 3 shows a perspective view of a portion of the glazing system 100. FIG. 4 shows a side view of FIG. 3. FIG. 5 shows a sectional view of FIG. 4. FIG. 6 shows a side perspective view of FIG. 3 showing a partial cutaway on the horizontal framing member 105; the glazing is removed for clarity. FIG. 7 shows a partial exploded view of FIG. 6. FIG. 8 shows a rear perspective view of a portion of the glazing system 100 showing two of the vertical framing members 103.

Referring to FIGS. 3-7, the glazing system 100 includes a vertical framing member 103, a horizontal framing member 105, a pressure bar assembly 107, a vertical framing member gutter 109, a horizontal framing member gutter 111, a vertical framing member enclosed cavity 113, and a horizontal framing member enclosed cavity 115. In FIGS. 3-5, the vertical framing member gutter 109 projects outwardly from the vertical framing member enclosed cavity 113 and forms a first seating surface for a glazing panel 117. The horizontal framing member gutter 111 projects outwardly from the horizontal framing member enclosed cavity 115 and forming a second seating surface for the glazing panel 117. The vertical framing member gutter 109 is deeper than the horizontal framing member gutter 111. The top edges of the vertical framing member gutter 109 and the horizontal framing member gutter 111 are aligned in the same plane in order to seat and secure a glazing panel 117. In FIGS. 3-7, the difference in depth between the vertical framing member gutter 109 and the horizontal framing member gutter 111 creates an offset between the vertical framing member enclosed cavity 113 and the horizontal framing member enclosed cavity 115 so that a portion of the vertical wall of the vertical framing member 103 aligns with the horizontal framing member enclosed cavity 115. This allows for the possibly of electrical wire 119 to be routed from the vertical framing member gutter 109 into the horizontal framing member enclosed cavity 115. A wire-receiving aperture 121 can be positioned in, and passing between, a region where the vertical framing member gutter 109 intersects the portion of the horizontal framing member enclosed cavity 115. In order to help reduce the possibility of air and moisture penetration and improve acoustical performance, and to prevent electrical wires chaffing against metal edges, any voids between the electrical wire and the aperture can be sealed with a flexible water proof or water resistant material. For example, the void can be sealed with silicone caulking or an elastomeric washer, grommet, or gasket.

Routing the electrical wire 119 between the vertical framing member gutter 109 into the horizontal framing member enclosed cavity 115, in the above described region, allows the electrical wire 119 to transfer from the exterior portion to an interior portion of the glazing system 100 while minimizing the possibility of water infiltration into the interior structure of the glazing system 100. For example, as positive pressure is applied by wind, rain, and other environmental elements to the glazing panel 117, any water infiltration will tend to be pressed against the horizontal framing member gutter 111 and flow down the sides of the vertical framing member gutter 109 until it hits the bottom sill and is drained out through weep holes. Direct pressure is not applied against the wire-receiving aperture 121.

FIG. 3 shows the electrical wire 119 routing down into the vertical framing member gutter 109. The electrical wire 119 is routed into the horizontal framing member enclosed cavity 115 through an wire-receiving aperture 121. The wire-receiving aperture 121 and wire are hidden from view in the horizontal framing member enclosed cavity 115 and are denoted by broken lines.

In FIG. 4, the cutaway section of the vertical framing member 103 shows the electrical wire 119 running down the vertical framing member gutter 109 and shows the relationship between the vertical framing member enclosed cavity 113, the vertical framing member gutter 109, the electrical wire 119, and the horizontal framing member enclosed cavity 115. Similarly in FIG. 6, a cutaway section of the horizontal framing member 105 reveals the electrical wire 119 entering the horizontal framing member enclosed cavity 115 through the wire-receiving aperture 121. The interior of the vertical framing member 103 is hidden. A broken line shows the position of the vertical framing member gutter 109 and the vertical framing member enclosed cavity 113 in relationship to the horizontal framing member enclosed cavity 115.

FIG. 5 shows a top cutaway view of FIG. 4 illustrating the horizontal framing member gutter 111 in relation to the glazing panel 117, the vertical framing member gutter 109 in relation to the horizontal framing member enclosed cavity 115, and the electrical wire 119 routing from the vertical framing member gutter 109 through the wire-receiving aperture 121 in the horizontal framing member enclosed cavity 115.

In FIG. 6, a horizontal framing member back surface 123 is removable in order to facilitate servicing the electrical wire 119 from inside the building. The horizontal framing member 105 can also hold junction boxes, transformers, and other equipment associated with the electrical wires 119. These are easily assessable by removal of the horizontal framing member back surface 123. In addition, removing horizontal framing member back surface 123 also allows for drilling the wire-receiving aperture 121 from the inside of the building during fabrication of the glazing system 100. A vertical framing member back surface 125 can also be made removable. An second wire-receiving aperture 121*a* can be drilled between the vertical framing member enclosed cavity 113 and the horizontal framing member enclosed cavity 115, as shown in FIG. 6 in order to route the electrical wire 119 between the two closed cavities. The combination of the second wire-receiving aperture 121*a* between the closed cavities and the removable back surfaces of both the horizontal framing member 105 and the vertical framing member 103 facilitates routing the electrical wire 119 between the vertical framing member enclosed cavity 113 and the horizontal framing member enclosed cavity 115 within the building structure. This structure allows the electrical wires 119 to be routed invisibly throughout the entire glazing system.

FIG. 7 shows the horizontal framing member back surface 123 and the vertical framing member back surface 125 removed from the horizontal framing member 105 and the vertical framing member 103. FIG. 8 shows a portion of the glazing system 100 with two of the vertical framing members 103. The vertical framing member 103 on the left hand side of FIG. 8 and the horizontal framing member 105 have their back covers removed to illustrate how electrical wire 119 can be routed through the horizontal framing member enclosed cavity 115 and the vertical framing member enclosed cavity 113 and are protected from the elements. On the right hand portion of FIG. 8, the electrical wire 119, which originates from the glazing panel 117, is routed through the vertical framing member gutter 109 through the wire-receiving aperture 121 between the vertical framing member gutter 109 and the horizontal framing member enclosed cavity 115. The electrical wire 119 is routed through the horizontal framing member enclosed cavity 115 through the second wire-receiving aperture 121*a* on the left hand portion of FIG. 8 into the vertical framing member enclosed cavity 113.

Referring back to FIGS. 3, and 5-7, the vertical element of the pressure bar assembly 107 is secured to a vertical framing member glazing support 127. Similarly, in FIGS. 3-7, and 6-7, the horizontal element of the pressure bar assembly 107 is secured to the horizontal framing member glazing support 129. This secures the glazing panel 117 to the vertical framing member 103 and the horizontal framing member 105. In FIGS. 3-5, gaskets 131 between the framing members and the glazing panel 117 and between the pressure bar assembly 107 and the glazing panel 117 provide a water resistant seal. The gaskets 131 are typically an elastomeric material such as silicon. Referring to FIG. 3, the height of the vertical framing member glazing support 127 is lengthened by an amount equal to the additional depth added to the vertical framing member gutter 109 in order for the top of both the vertical framing member glazing support 127 and the top of the horizontal framing member glazing support 129 to lie in the same plane. This helps to ensure that the pressure bar assembly 107 will lie in the same plane as, and provide equal pressure to, the glazing panel 117.

Figure 9:
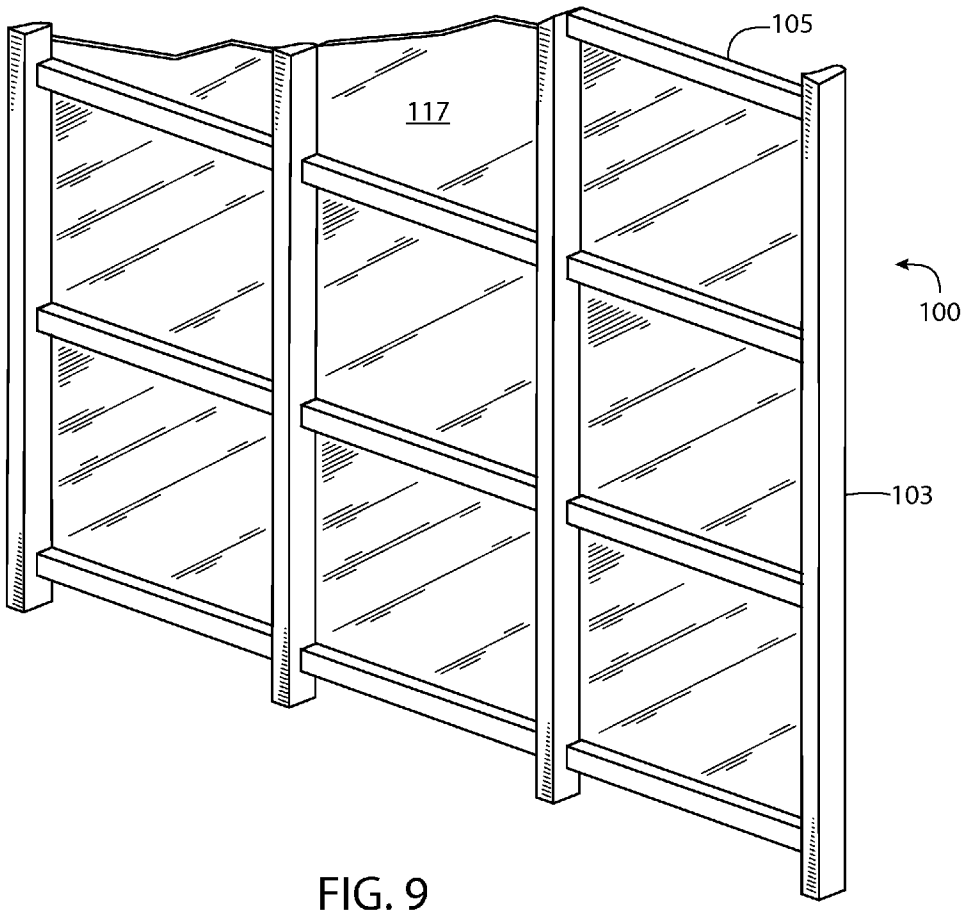
FIG. 9 shows a section of a vertical glazing system in accordance FIG. 3.

The novel structure described for FIGS. 3-8 can be applied a wide range of vertical and sloped glazing systems. FIG. 9 shows the glazing system 100 applied to a stick-built vertical curtain wall. The vertical curtain wall includes the vertical framing member 103, the horizontal framing member 105, and the glazing panel 117 and includes the novel arrangement of framing members as previously described.

Figure 10:
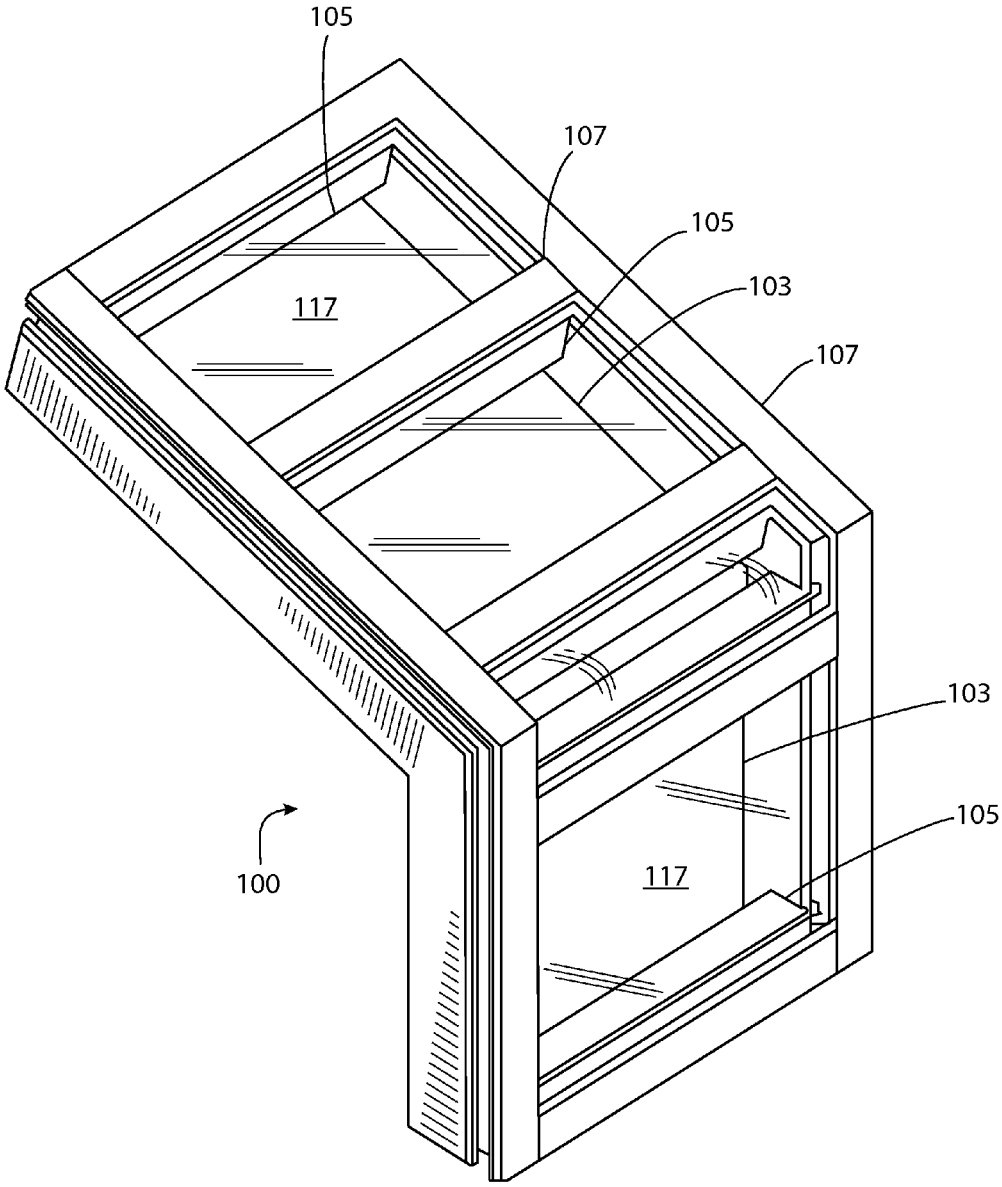
FIG. 10 shows a section of a sloped glazing system in accordance with FIG. 3
Figure 11:
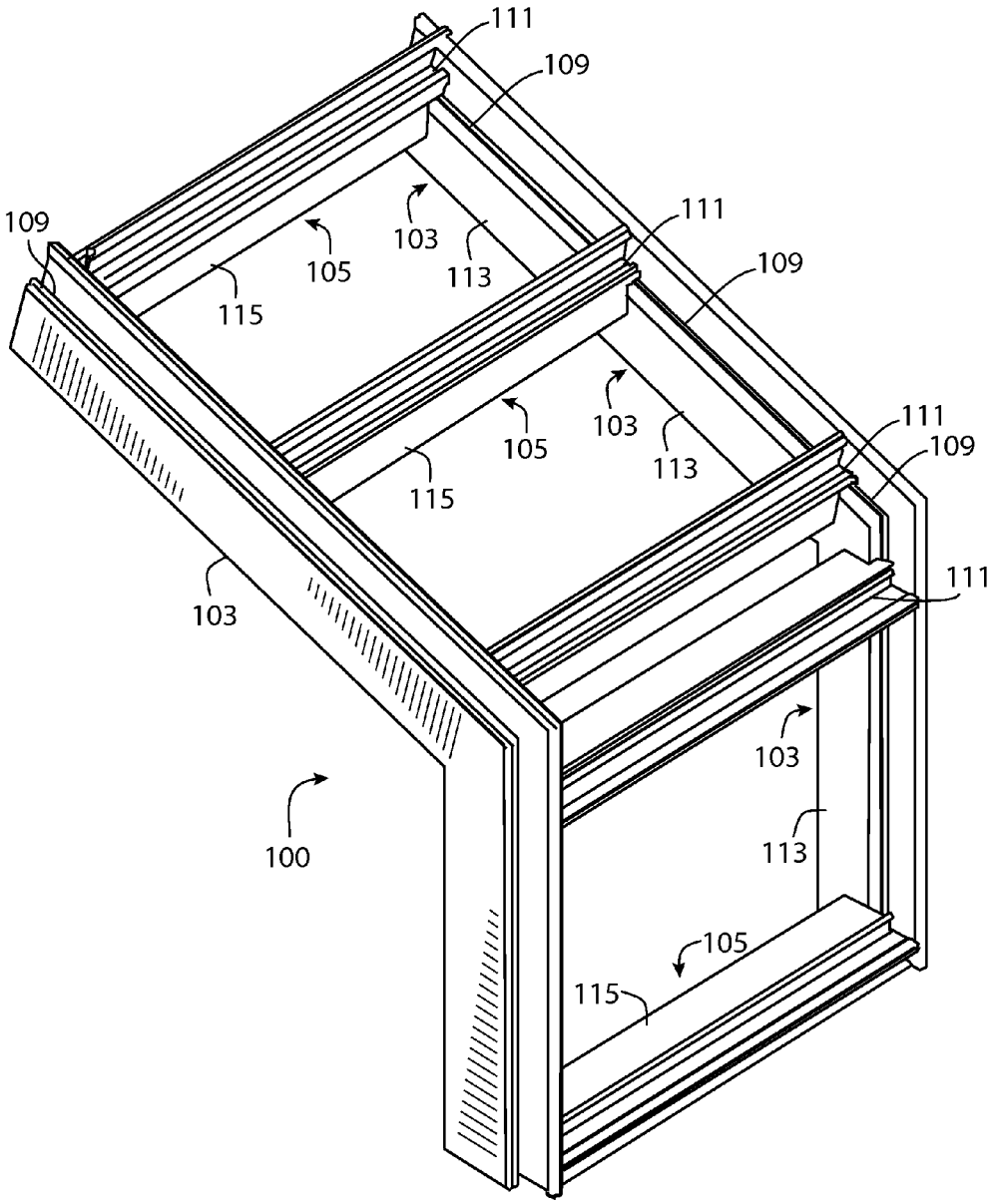
FIG. 11 shows the sloped glazing section of FIG. 10 with the pressure bars, face caps, and gaskets removed for clarity.

FIGS. 10-11 show the glazing system 100 applied to a sloped glazing system. FIG. 10 shows a section of the sloped glazing system including the glazing panels 117, pressure bar assembly 107, vertical framing members 103 in the form of rafters, and horizontal framing members 105 in the form of purlins. FIG. 11 shows the portion of the glazing system 100 with the pressure bar assembly 107 and the glazing panels 117 of FIG. 10 removed for clarity. Referring to FIG. 11, the vertical framing member gutter 109 is deeper than the horizontal framing member gutter 111. The top edges of the vertical framing member 103 and the horizontal framing member 105 are aligned in the same plane in order to seat and secure a glazing panel 117 as illustrated in FIG. 10. In FIG. 11, the difference in depth between the vertical framing member gutter 109 and the horizontal framing member gutter 111 creates an offset between the vertical framing member enclosed cavity 113 and the horizontal framing member enclosed cavity 115 so that a portion of the vertical wall of the vertical framing member 103 aligns with the horizontal framing member enclosed cavity 115. This facilitates the wire routing described for FIGS. 3-8.

Figure 12:
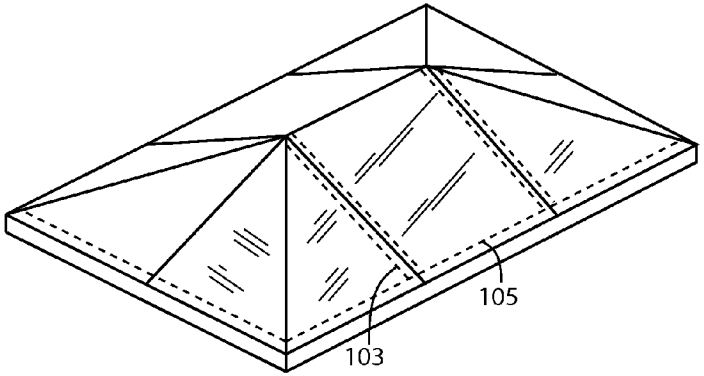
FIG. 12 shows a hipped-end skylight in accordance with FIGS. 3 and 11.
Figure 13:
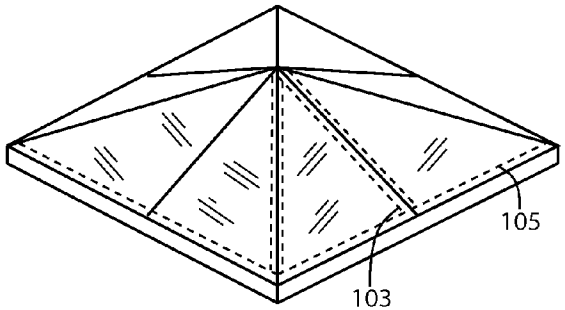
FIG. 13 shows a pyramid skylight in accordance with FIGS. 3 and 11.
Figure 14:
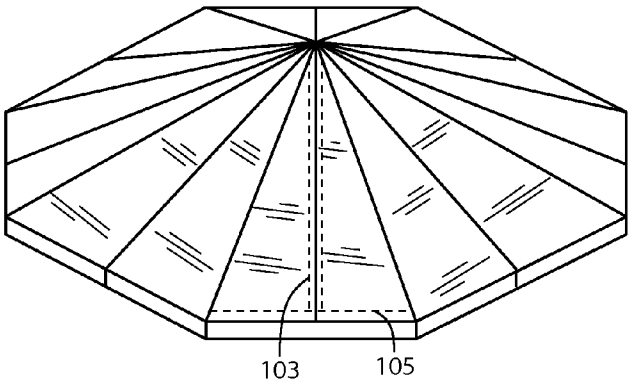
FIG. 14 shows a polygon shaped skylight in accordance with FIGS. 3 and 11.

FIGS. 12-14 show other typical sloped glazing systems where the novel structure described for FIGS. 3-11 can be applied. FIG. 12 shows a hipped-end skylight, FIG. 13 shows a pyramid skylight, and FIG. 14 shows a polygon shaped skylight with the vertical framing members 103 and the horizontal framing members 105 arranged in accordance with FIGS. 3 and 11. The vertical framing members 103 and portions of the horizontal framing members 105 are hidden from view and represented in the figure by broken lines.

Both vertical and sloped glazing systems that facilitate wire routing to electrically producing or consumptive glazing materials has been described. It is not the intent of this disclosure to limit the claimed invention to the examples, variations, and exemplary embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that, the scope of the claimed invention is defined solely by the following claims and their equivalents.

What is claimed is:

1. A glazing system, for mounting a glazing panel, comprising:

a first framing member including a first framing member enclosed cavity, and a first framing member gutter projecting outwardly from the first framing member enclosed cavity;

a second framing member including a second framing member enclosed cavity, and a second framing member gutter projecting outwardly from the second framing member enclosed cavity;

the first framing member gutter and the second framing member gutter each seat the glazing panel utilizing an offset glazed system; and the first framing member is secured and aligned with the second framing member so that the first framing member gutter and the first framing member enclosed cavity intersect a portion of the second framing member enclosed cavity but the first framing member enclosed cavity does not intersect the second framing member gutter.

2. The glazing system of claim 1, further comprising:

a wire-receiving aperture positioned in, and passing between, a region where the first framing member gutter intersects the portion of the second framing member enclosed cavity.

3. The glazing system of claim 2, wherein:

the second framing member enclosed cavity includes a back surface; and the back surface is removable.

4. The glazing system of claim 2, further comprising:

a second wire-receiving aperture positioned in, and passing between, a second region where the first framing member enclosed cavity and the portion of the second framing member enclosed cavity intersect.

5. The glazing system of claim 4 wherein:

the first framing member enclosed cavity includes a first back surface;

the second framing member enclosed cavity includes a second back surface; and the first back surface and the second back surface are removable.

6. The glazing system of claim 1, further comprising:

a first pressure bar assembly, that in combination with the first framing member gutter, seat opposing surfaces of the glazing panel in a first direction along a first framing member length; and a second pressure bar assembly, that in combination with the second framing member gutter, seat opposing surfaces of the glazing panel in a second direction along a second framing member length.

7. The glazing system of claim 1, wherein:

the glazing system is a stick-built curtain wall;

the second framing member is a horizontal mullion; and the first framing member is a vertical mullion.

8. The glazing system of claim 1, wherein:

the glazing system is a sloped glazing system;

the second framing member is a purlin; and the first framing member is rafter.

9. The glazing system of claim 1, wherein:

the glazing system forms a unitized curtain wall section;

the second framing member is a horizontal mullion; and the first framing member is a vertical mullion.

10. The glazing system of claim 9, wherein:

the glazing system forms a section of a modular sloped glazing system;

the second framing member is a purlin; and the first framing member is a rafter.

11. A glazing system, for mounting a glazing panel between an interior space and exterior environment, comprising:

a first framing member including a first framing member enclosed cavity positioned within the interior space, and a first framing member gutter projecting outwardly from the first framing member enclosed cavity and configured to seat an interior surface of the glazing panel;

a second framing member including a second framing member enclosed cavity positioned fully within the interior space, and a second framing member gutter projecting outwardly from the second framing member enclosed cavity and confirmed to seat the interior surface of the glazing panel;

the first framing member gutter and the second framing member gutter each seat the glazing panel utilizing an offset glazed system; and the first framing member is secured and aligned with the second framing member so that the first framing member gutter and the second frame member enclosed cavity intersect a portion of the second framing member enclosed cavity but the first framing member enclosed cavity does not intersect the second frame member gutter.

12. The glazing system of claim 11, further comprising:

a wire-receiving aperture positioned in, and passing between, a region where the first framing member gutter intersects the portion of the second framing member enclosed cavity.

13. The glazing system of claim 12, wherein:

the second framing member enclosed cavity includes a back surface; and the back surface is removable.

14. The glazing system of claim 12, further comprising:

a second wire-receiving aperture positioned in, and passing between, a second region where the first framing member enclosed cavity and the portion of the second framing member enclosed cavity intersect.

15. The glazing system of claim 14, wherein:

the first framing member enclosed cavity includes a first back surface;

the second framing member enclosed cavity includes a second back surface; and the first back surface and the second back surface are removable.

16. The glazing system of claim 11, further comprising:

a first pressure bar assembly, that in combination with the first framing member gutter, seat opposing surfaces of the glazing panel in a first direction along a first length of the first framing member; and a second pressure bar assembly, that in combination with the second framing member gutter, seat opposing surfaces of the glazing panel in a second direction along a second length of the second framing member.

* * * * *

UNITED STATES PATENT AND TRADEMARK OFFICE

CERTIFICATE OF CORRECTION

PATENT NO. : 8,800,221 B1
APPLICATION NO. : 13/902553
DATED : August 12, 2014
INVENTOR(S) : Gregory Header It is certified that error appears in the above-identified patent and that said Letters Patent is hereby corrected as shown below:

IN THE CLAIMS:

In Claim 11, column 8, line 30: change “confirmed” to --configured--

Signed and Sealed this
Fourteenth Day of October, 2014

Michelle K. Lee

Michelle K. Lee
*Deputy Director of the United States Patent and Trademark Office*